US005580114A

United States Patent [19]

Palmer

[11] Patent Number: 5,580,114

[45] Date of Patent: Dec. 3, 1996

[54] HYDRAULICALLY ACTUATED FISHING TOOL

[75] Inventor: Larry T. Palmer, Houston, Tex.

[73] Assignee: Baker Hughes Incorporated, Houston, Tex.

[21] Appl. No.: 345,567

[22] Filed: Nov. 25, 1994

[51] Int. Cl.[6] ..... E21B 31/18; E21B 31/20

[52] U.S. Cl. ..... 294/86.15; 294/86.25; 294/86.3; 294/86.33

[58] Field of Search ..... 294/86.15, 86.17, 294/86.24, 86.25, 86.26, 86.28, 86.3, 86.32.86.33

[56] References Cited

U.S. PATENT DOCUMENTS

| | | | |
|---|---|---|---|
| 803,450 | 10/1905 | Stegner . | |
| 808,378 | 12/1905 | Johnston . | |
| 1,457,139 | 5/1923 | Bell et al. . | |
| 1,580,352 | 4/1926 | Ventresca . | |
| 1,619,254 | 3/1927 | Hart . | |
| 1,621,947 | 3/1927 | Moore . | |
| 1,638,494 | 8/1927 | Lewis et al. . | |
| 1,712,898 | 5/1929 | Newkirk . | |
| 1,719,584 | 7/1929 | Bonner | 294/86.15 |
| 1,728,136 | 9/1929 | Power . | |
| 1,779,123 | 10/1930 | Gates . | |
| 1,794,652 | 3/1931 | Stone . | |
| 1,815,462 | 7/1931 | Denney . | |
| 1,823,340 | 9/1931 | Vance . | |
| 1,917,135 | 7/1933 | Littell . | |
| 2,141,987 | 12/1938 | Jones . | |
| 2,290,409 | 7/1942 | Cuthill . | |
| 2,507,127 | 5/1950 | True | 294/86.33 |
| 2,550,080 | 4/1951 | Moore . | |
| 2,663,370 | 12/1953 | Donnell et al. . | |
| 2,732,901 | 1/1956 | Davis . | |
| 2,806,534 | 9/1957 | Potts . | |
| 3,145,750 | 8/1964 | Wootton . | |
| 3,199,906 | 8/1965 | Chenoweth . | |
| 3,262,501 | 7/1966 | Winger . | |
| 3,265,431 | 8/1966 | Burner | 294/86.25 |
| 3,283,823 | 11/1966 | Warrington . | |
| 3,638,989 | 2/1972 | Sandquist . | |
| 3,752,230 | 8/1973 | Bernat et al. . | |
| 3,785,690 | 1/1974 | Hutchinson . | |
| 4,124,245 | 11/1978 | Kuenzel . | |
| 4,157,199 | 6/1979 | Klingman . | |
| 4,273,372 | 6/1981 | Sheshtawy . | |
| 4,443,130 | 4/1984 | Hall . | |
| 4,616,721 | 10/1986 | Furse . | |
| 5,242,201 | 9/1993 | Beeman | 294/86.17 |

FOREIGN PATENT DOCUMENTS

| | | |
|---|---|---|
| 213798 | 8/1986 | European Pat. Off. . |

OTHER PUBLICATIONS

Drawing: Baker #49 "Retrieva–D" Lok–Set Packer Retrieving Tool, Product No. 646–17, Dec. 15, 1975.

Drawing: Baker Size 49Da47 Retrieving Tool, F/47Da47 Size "Retrieva–D" Packer, Product No. 646–17; Sep. 3, 1975.

Drawing: Baker #49 "Retrieva–D" Lok–Set Packer with "DB" Bottom, Product No. 646–16, Aug. 19, 1971.

*Primary Examiner*—Dean Kramer

*Attorney, Agent, or Firm*—Rosenblatt & Redano P.C.

[57] ABSTRACT

A fishing tool is disclosed which is responsive to hydraulic pressure to move away support for collets to allow the collets to deflect and make contact with the stuck object. Upon removal of the hydraulic force, the support for the collets is returned, preferably by a biasing spring, to its original position to lend support for the collets while the collets have engaged the stuck object. The object can then be retrieved to the surface. Application of further hydraulic force while the object engaged releases the support for the collects which allows the collets to disengage from the object. The process can be repeated to obtain successive releases and engagements with the stuck object without taking the fishing tool out of the wellbore.

16 Claims, 4 Drawing Sheets

HYDRAULICALLY ACTUATED FISHING TOOL

FIELD OF THE INVENTION

The field of this invention relates to tools usable for retrieval of objects from subterranean wells. There are generally two types of these tools. A spear engages the inside of the stuck object while an overshot engages the outside of a stuck object. As referred to in this patent application, the words "fishing tool," "spear," and "overshot" will be used interchangeably such that fishing tool refers to both spears and overshots, a spear also refers to an overshot, while an overshot also refers to a spear.

BACKGROUND OF THE INVENTION

Many times during operations in a wellbore, objects become stuck and must be retrieved from the wellbore. Sometimes the casing or tubing can experience a catastrophic failure and must be retrieved from the wellbore. In the past, various mechanical designs have been used which generally involve a series of mechanically actuated grippers to slips to grab the object to be retrieved or "fish" so that it can be brought to the surface. Many of these designs employed shear pins that have to be sheared to allow release from the fish, if required. These tools were not resettable because once the shear pin was broken the fishing tool had to be brought to the surface so that the shear pin could be redressed. Additionally, the use of shear pins limited the upward pull that could be exerted on the fishing tool. Operators of fishing tools that had shear pins had to be careful not to exert too great a pulling force or else the fishing tool would accidently release the fish. Another drawback of shear pins was that they would release at smaller values of forces than anticipated. This was primarily due to the cyclical stresses imposed on shear pins which, over time, would weaken them and make them release or fail at pulling forces lower than anticipated.

Various tools, in the past, have employed different mechanisms to set the slips. Some have done so mechanically, while others have done so hydraulically. Typical of such tools are U.S. Pat. Nos. 808,378 (mechanically set); 803,450 (hydraulically set); 1,457,139 (hydraulically set); 1,728,136 (hydraulically set); 1,619,254 (hydraulically set); 1,580,352 (hydraulically set); 1,621,947 (hydraulically set); 1,638,494 (hydraulically set); 1,712,898 (hydraulically set); 1,779,123; 1,794,652; 1,815,462; 1,917,135; 2,141,987; 2,290,409; 2,806,534; 2,732,901; 3,638,989; and 3,262,501. Some of these tools employ hydraulic force to move a piston to in turn move a mechanical member which in turn sets the slips for gripping. Thereafter, some mechanical action is required to release the slips, such as breaking a shear pin or by pulling up on the tool with sufficient force. Also of interest is European Application 0213798, which discloses a packer retrieval assembly. This device presents two different outside diameters so that it can be inserted through a packer and expanded to its larger diameter for retrieving the packer. This apparatus also uses shear pins to actuate from one position to another. U.S. Pat. No. 4,616,721 shows a packer retrieval tool having a milling feature for cutting loose the slips. This tool can disengage the packer only by failure of a ring component from hoop tension. At that point, the packer falls to its original position and the tool must be removed from the well to be reset.

Also of interest to the field of this invention is a packer retrieving tool product No. 646-17 made by Baker Oil Tools and referred to as BAKER 43 RETRIEVA-D LOK-SET® which is used to retrieve BAKER 43 RETRIEVA-D LOK-SET® packers.

A fishing tool that releases hydraulically and which can release from the fish and reattach to the fish without removal to the surface is illustrated in U.S. Pat. No. 5,242,201.

SUMMARY OF THE INVENTION

A fishing tool is disclosed which is responsive to hydraulic pressure to move away support for collets to allow the collects to deflect and make contact with the stuck object. Upon removal of the hydraulic force, the support for the collets is returned, preferably by a biasing spring, to its original position to lend support for the collets while the collets have engaged the stuck object. The object can then be retrieved to the surface. Application of further hydraulic force while the object engaged releases the support for the collects which allows the collets to disengage from the object. The process can be repeated to obtain successive releases and engagements with the stuck object without taking the fishing tool out of the wellbore.

DETAILED DESCRIPTION OF THE PREFERRED EMBODIMENT

Figure 1:
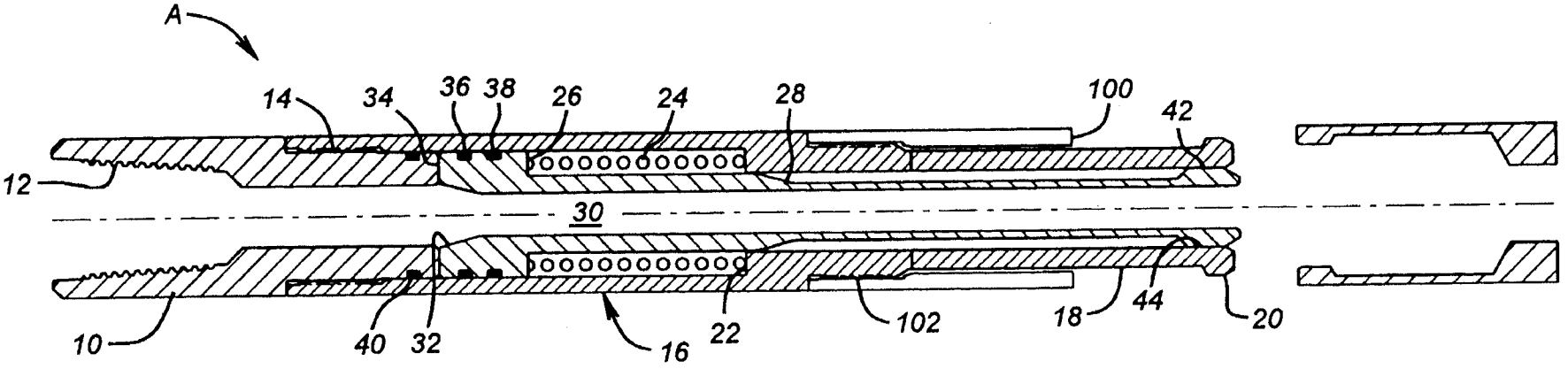
FIG. 1 is a sectional view of the spear of the present invention in the run-in position.
Figure 2:
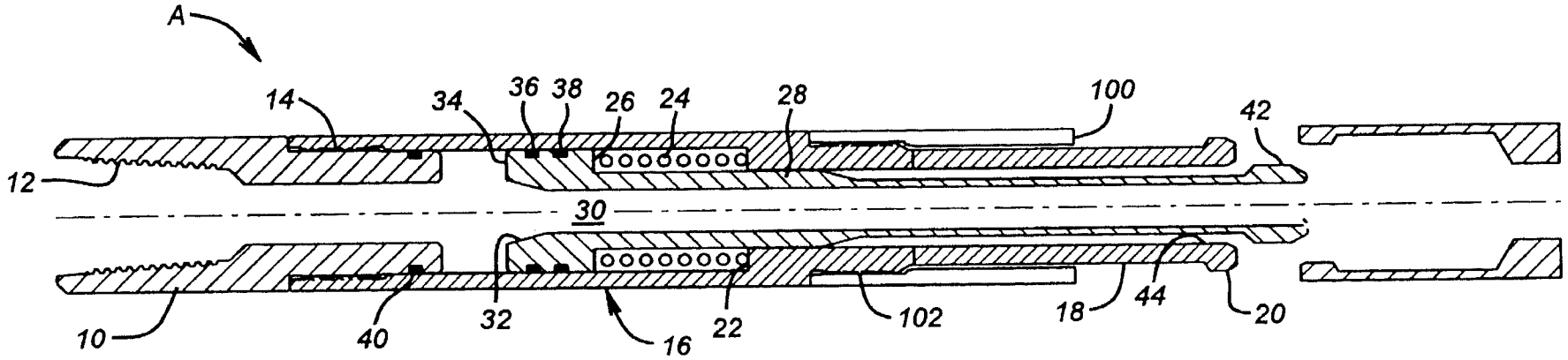
FIG. 2 is the view of FIG. 1 with hydraulic pressure applied to the spear to remove support for the collets.
Figure 3:
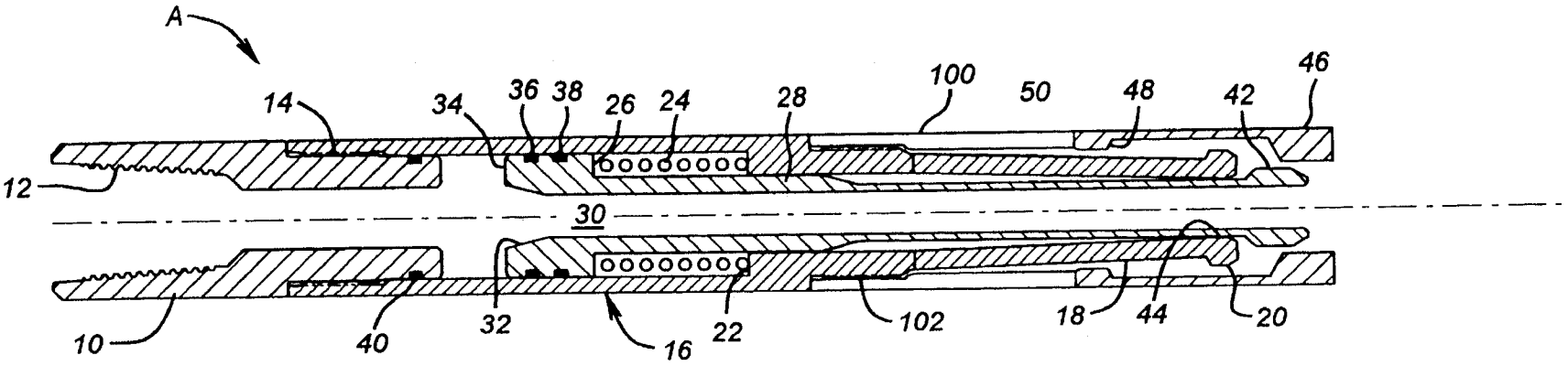
FIG. 3 is the view of FIG. 2 showing advancement of the spear into the fish.
Figure 4:
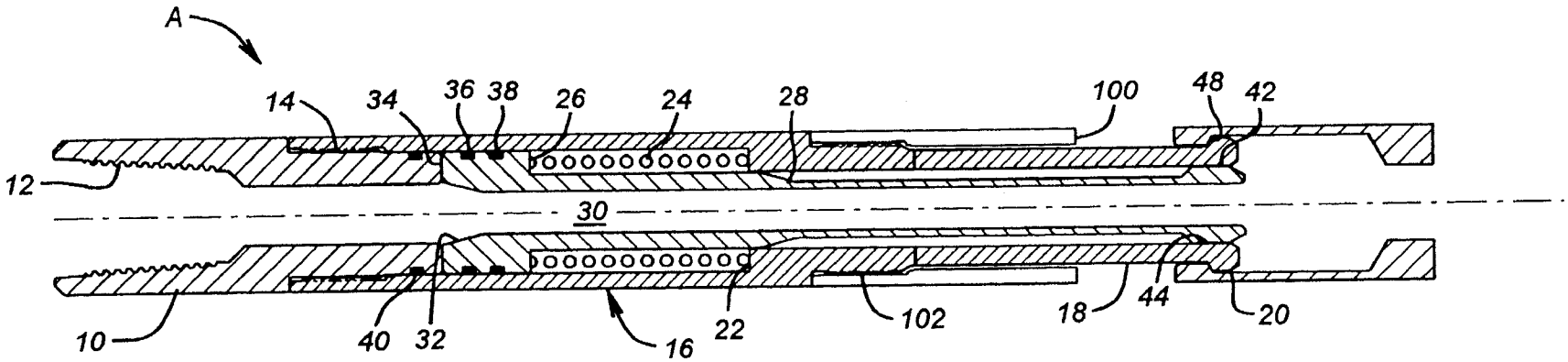
FIG. 4 is the view of FIG. 3 with the hydraulic pressure removed and an upward force applied to the spear to firmly engage the fish.

The apparatus A of the present invention is shown in the run-in position in FIG. 1. It has a top sub 10 which has a thread 12. Thread 12 can be used to engage rigid or coiled tubing (not shown). The top sub 10 has a thread 14 which engages the collet member 16. The collet member terminates in a plurality of fingers 18, each of which terminates in a head 20. Collet member 16 has an internal shoulder 22 which supports a spring 24. Spring 24 bears on shoulder 26 of mandrel 28. Mandrel 28 has a central bore 30 which results from a taper 32 adjacent its upper end 34. Bore 30 continues beyond taper 32 into top sub 10 so that it is in fluid communication with the rigid tubing or coiled tubing (not shown). Mandrel 28 is mounted for relative movement with respect to collet member 16 with O-rings 36 and 38 mounted therebetween. Another O-ring 40 is mounted between top sub 10 and collet member 16. In the run-in position, the heads 20 are fully supported by mandrel 28 when surface 42 of mandrel 28 abuts surface 44 adjacent the heads 20. As seen in FIG. 2, when hydraulic pressure is applied by flow through bore 30, a force is exerted on taper 32 and upper end 34 due to the constricting effect and the presence of O-rings 36 and 38 and 40. Due to the unbalanced force on the mandrel 28, it is displaced downwardly, as shown in FIG. 2, such that surface 42 is removed by longitudinal translation away from surface 44. The fingers 18 become unsupported, as shown in FIG. 2. Thereafter, as shown in FIG. 3, the apparatus A is advanced into the fish 46. The fish 46 has an internal neck 48. Since the support for fingers 18 has been removed, they can flex radially inwardly toward surface 50 on the mandrel 28. Having attained this position shown in FIG. 3, the applied pressure to mandrel 28 through bore 30 is removed. This allows the spring 24 to return the mandrel 28 back to the position shown in FIG. 1. The support is thus returned to the collet heads 20, as shown in FIG. 4. As seen in FIG. 4, the heads 20 engage the fishing neck 48 while surface 42 of mandrel 28 fully supports surface 44 on fingers 18. The fish 46 is now ready to be lifted from the wellbore. If, for any reason, the operator decides to release the fish, the mere application of fluid pressure to the mandrel 28 by flow through bore 30 will once again displace the mandrel 28 downwardly to take away support for the collet heads 20. The operator simply applies pressure from the rigid or coiled tubing (not shown) while taking off the pulling force applied to the apparatus A and compressing spring 24 so as to reattain the position shown in FIG. 3. Thereafter, by simply maintaining the hydraulic pressure applied to the mandrel 28, the apparatus A can be detached from the fish by simply pulling upwardly.

Figure 5:
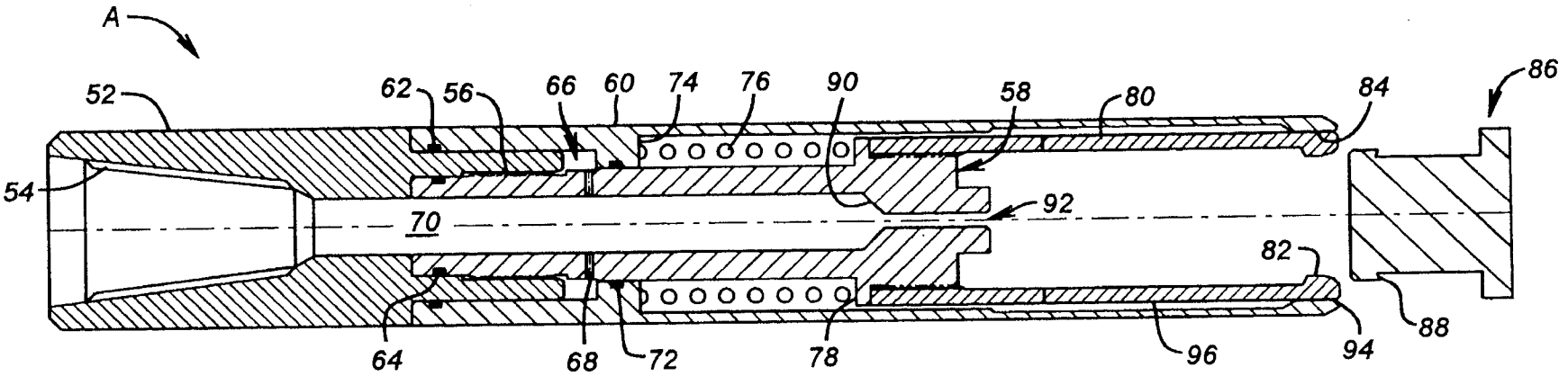
FIG. 5 is the run-in position in a sectional view of an overshot of the present invention.

Referring now to FIGS. 5–8, the detailed operation of the overshot of the preferred embodiment will be explained. As shown in FIG. 5, the overshot has a top sub 52 which has a thread 54. Thread 54 is used to attached rigid or coiled tubing (not shown). The top sub 52 has another thread 56 which is used to engage the collet assembly 58. Mounted over the collet assembly 58 is a mandrel 60. O-ring 62 seals between mandrel 60 and top sub 52. O-ring 64 seals between top sub 52 and collet assembly 58. A cavity 66 is formed between the collet assembly 58 and the mandrel 60. A lateral port or ports 68 connect bore 70 in collet assembly 58 to cavity 66. O-ring 72 is also mounted between collet assembly 58 and mandrel 60 to facilitate sealing variable volume cavity 66. The mandrel 60 has an internal shoulder 74 on which bears spring 76. Spring 76 also bears on shoulder 78 of collet assembly 58. Collet assembly 58 has a series of elongated fingers 80 which terminate at heads 82. In the run-in position shown in FIG. 5, the heads 82 are supported by surface 84 of mandrel 60. To facilitate latching onto the fish 86, a fishing neck 88 is provided.

Figure 6:
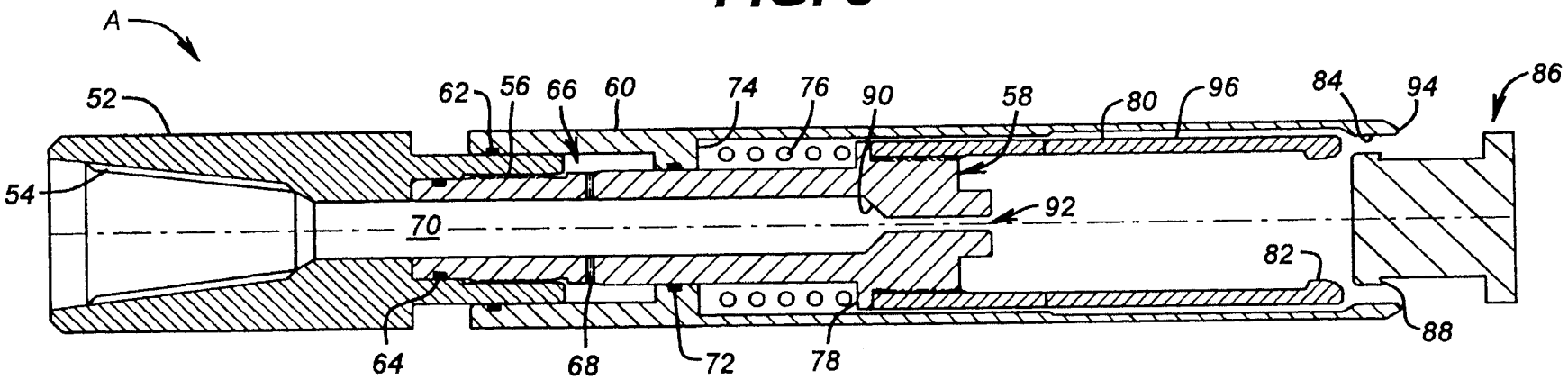
FIG. 6 is the view of FIG. 5 with hydraulic pressure applied to the overshot to remove support for the collets.
Figure 7:
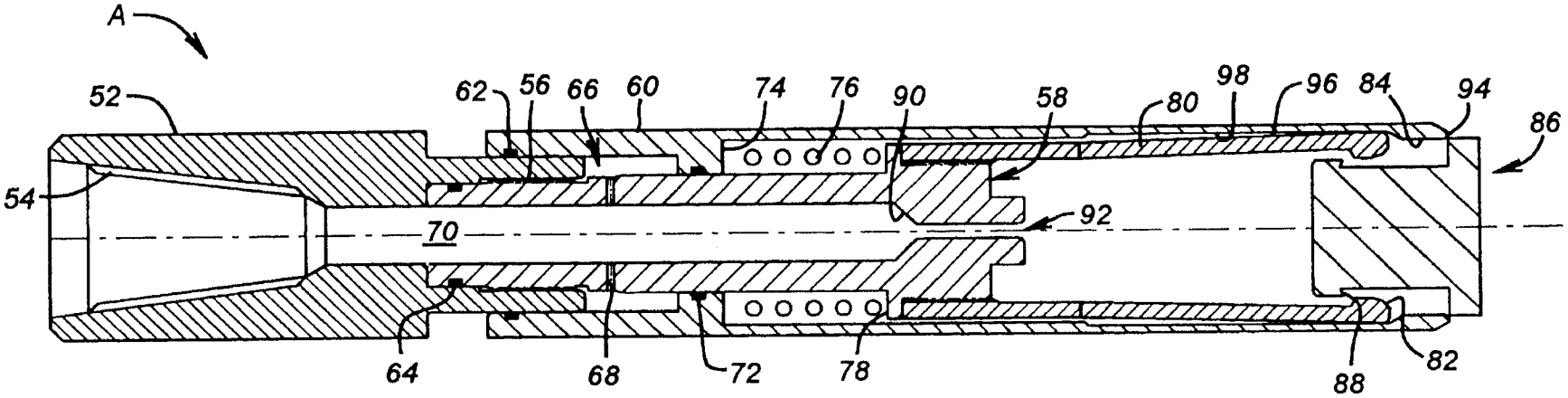
FIG. 7 is the view of FIG. 6 showing the overshot advanced over the fish while hydraulic pressure is applied.

In order to facilitate engagement of the fish 86, hydraulic pressure is applied through rigid or coiled tubing (not shown) and into bore 70. Bore 70 has a taper 90 which creates a smaller bore 92. As flow goes through smaller bore 92, it creates a backpressure in larger bore 70 which is in turn communicated through port 68 into variable volume cavity 66. As pressure builds up in cavity 66, the mandrel 60 is displaced, shown by comparing FIG. 6 to FIG. 5. Variable volume cavity 66 has enlarged in the view of FIG. 6 due to the additional pressure applied therein coupled with movement of mandrel 60 to compress spring 76. Since the top sub 52 is retained stationary by the coiled or rigid tubing (not shown) and the collet assembly 58 is securely mounted to the top sub 52 at thread 56, the lower end 94 of mandrel 60 moves longitudinally beyond the heads 82. When this occurs, surface 84 of mandrel 60, which is an annular member, no longer supports the fingers 80 at each one of their surfaces 96. While maintaining the hydraulic pressure that overcomes the force of spring 76 and advancing the apparatus A, as shown in FIG. 6, the collet heads 82 can flex outwardly to clear the fishing neck 88, as shown by comparing FIG. 6 to FIG. 7. It should be noted that the spring 76 remains in the compressed state in FIGS. 6 and 7 because the hydraulic pressure is maintained as the apparatus A is advanced. Having sufficiently advanced the apparatus A with hydraulic pressure applied to cavity 66, the hydraulic pressure is released allowing spring 76 to retract the mandrel 60 thus placing surface 84 back in a position to support the heads 82 at each surface 96. A simple upward pull on the apparatus A when attaining the position shown in FIG. 8 will allow removal of the fish 86. As with the spear, the overshot shown in FIGS. 5–8 can be released having grabbed the fish 86 by simply applying hydraulic pressure back into bore 70. This is accomplished by allowing flow through the restriction which is created by bore 92. By doing this, the apparatus A will be placed once again in the position shown in FIG. 7 where a mere upward pull is sufficient to allow release from the fish 86. This is because the heads 82 can flex radially outwardly toward surface 98 when shown in the position of FIG. 7 to either facilitate grabbing the fish 86 or releasing therefrom.

Those skilled in the art will appreciate that as to the overshot of FIGS. 5–8, the hydraulic force can be created in several different ways without departing from the spirit of the invention. The preferred mode is shown in FIGS. 5–8. In another mode, for example, the bore 92 may be eliminated completely so that the hydraulic pressure in cavity 66 can be created without any flow through the collet assembly 58. Alternatively, the components can be reconfigured so as to allow the use of annulus pressure as opposed to the pressure inside rigid tubing or coiled tubing (not shown) which is attached to top sub 52 to actuate the components as described. As one example, the lateral port 68 instead of communicating to bore 70 can be reconfigured to extend from cavity 66 radially outwardly through the mandrel 60 and into the annular space. To the extent it is possible to pressurize the annulus, the apparatus can be operated in that manner.

While a spring has been disclosed as the preferred embodiment for returning the mandrel 60 (see FIG. 8) or the mandrel 28 (see FIG. 4) to its run-in position other devices can be employed to put a biasing force on the mandrel without departing from the spirit of the invention. These components could include different types of springs or the application of available hydraulic pressure to obtain the requisite movement of the mandrel 60 or 28 to its run-in position shown in FIGS. 5 and 1, respectively.

It should be noted that the presence of O-rings 36, 38, and 40 facilitate the application of the applied hydraulic pressures due to the flow through bore 30 onto the mandrel 28 to facilitate its displacement against the opposing force of spring 24. Similarly, O-rings 62, 64, and 72 provide the necessary seals for variable volume cavity 66 so that when pressure is applied therein from flowthrough bores 70 and 92, the force applied to mandrel 60 overcomes the opposing force of spring 76.

Figure 8:
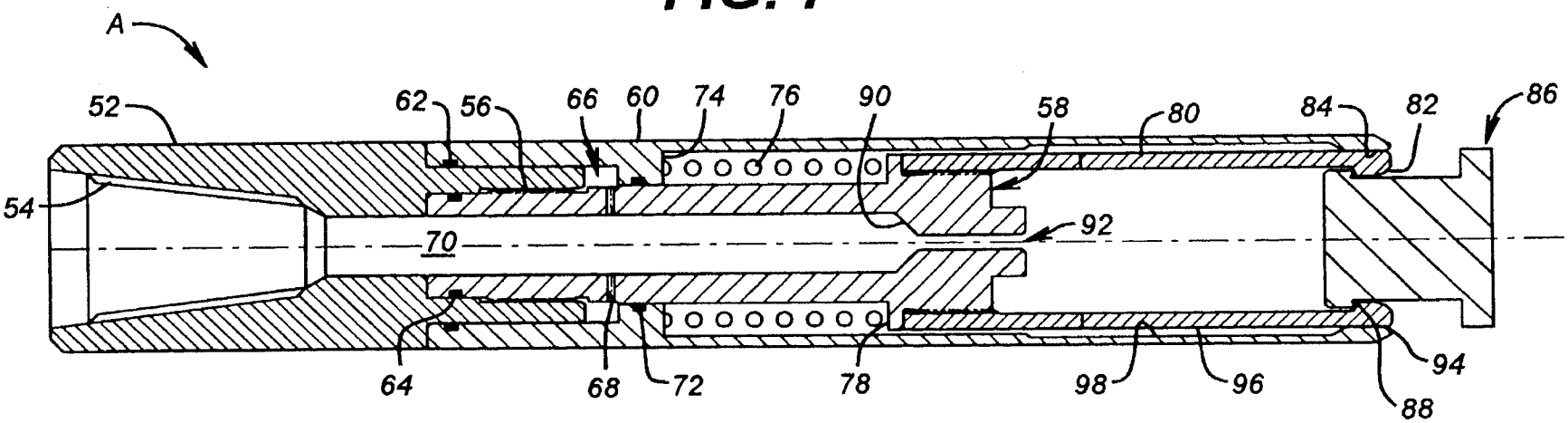
FIG. 8 is the view of FIG. 7 showing the removal of hydraulic pressure combined with an upward pull on the overshot to firmly engage the overshot to the fish.

Those skilled in the art will appreciate that the application of hydraulic force is used to displace a mandrel away from a collet or collets which it supports prior to bringing the apparatus A into engagement with the fish. Once the engagement is obtained, the fishing neck 48 of the fish 46 is fully supported by the heads 20 which are in turn backed up by the annular member mandrel 28. Similarly, in the case of the overshot of the present invention, the fishing neck 88 is fully supported by the heads 82 as backed up by the mandrel 60. The physical limits of pull that can be applied to a fish, such as 86, is limited only by the physical strength of the fingers 80 with their heads 82 when fully supported by the mandrel 60, as shown in FIG. 8. The same holds true for the spear in the position shown in FIG. 4.

As shown in FIG. 1, a sleeve 100 can be used and connected to collet member 16 at thread 102. Sleeve 100 can protect the collets against damage during handling. Such a sleeve is not used in the overshot, as illustrated in FIGS. 5–8, primarily for the reason that the annularly-shaped sleeve 60, which is on the exterior of the overshot, serves to protect the collet fingers 80 and heads 82.

Those skilled in the art will appreciate by examining FIGS. 4 and 8 that the weight of the fish 46 or 86 is fully supported by the collet heads 20 or 82 with radial support being provided by the mandrel 28 or 60, respectively. In the case of the spear of FIG. 1, the mandrel 28 radially supports the heads 20 from within, while in the overshot the parts are reversed and the mandrel 60 supports the heads 82 from outside.

The foregoing disclosure and description of the invention are illustrative and explanatory thereof, and various changes in the size, shape and materials, as well as in the details of the illustrated construction, may be made without departing from the spirit of the invention.

I claim:

1. A fishing tool for retrieving an object from a wellbore comprising:

a body having a longitudinal axis;

at least one gripping member mounted to said body in a manner where it forms an extension of said body;

a mandrel selectively movable with respect to said gripping member in the direction of said longitudinal axis between a first position where it supports said gripping member and a second position where it does not support said gripping member, said gripping member having an end movable in opposed directions in a plane transverse to said longitudinal axis, said mandrel responsive to fluid pressure for movement between its said first and second position, said movement required in order to allow said gripping member to grab the object;

a biasing member acting on said mandrel to urge it toward its said first position; and said body is formed having a bore therethrough in fluid communication with said mandrel whereupon fluid flow in said bore creates a pressure which overcomes said biasing member to urge said mandrel toward its said second position.

2. The apparatus of claim 1, wherein said mandrel has a bore therethrough in fluid communication with said bore in said body.

3. The apparatus of claim 2, wherein:

said bore in said mandrel is smaller at least in part than said bore in said body for creation of a flow restriction which, upon fluid flow therethrough, creates a back pressure urging said mandrel from said first toward said second position.

4. The apparatus of claim 3, wherein:

said gripping member comprises a plurality of collet fingers each terminating in a head; and said fingers fixed against longitudinal movement with respect to said body, said heads on said fingers movable radially toward said mandrel when said mandrel is placed into its said second position.

5. The apparatus of claim 4, wherein:

said heads when displaced radially toward said mandrel facilitate selective engagement and release from the object.

6. The apparatus of claim 1, wherein:

said mandrel forms a variable volume cavity with said body;

said body formed having at least one port allowing fluid communication from said bore into said cavity;

whereupon application of fluid pressure in said bore, said port communicates such pressure to said variable volume cavity to urge said mandrel toward its said second position.

7. The apparatus of claim 1, wherein:

said biasing member comprises a coiled spring supported by said gripping member.

8. A method of fishing for an object in a wellbore comprising:

lowering a fishing tool toward the object with a tubing string;

applying fluid flow through said tubing string to create pressure in the body of said fishing too, said body having a longitudinal axis;

mounting at least one collet as an extension of said body;

providing an end on said collet movable in a plane transverse to the longitudinal axis of said body;

displacing a mandrel away from support of said collet with applied fluid flow which creates said pressure;

moving the tool with said fluid pressure applied until the object is engaged;

removing the applied fluid pressure; and returning said mandrel to a position where the collet is supported to secure the object.

9. The method of claim 8, further comprising the step of:

creating said fluid pressure by flowing a fluid into said fishing tool.

10. The method of claim 9, further comprising the step of biasing said mandrel to return it to a position where said collet is supported.

11. The method of claim 10, further comprising the step of longitudinally moving a raised surface on said mandrel away from a head on a collet;

radially flexing the collet toward said mandrel; and facilitating attachment and release from the object by said radial flexing.

12. The method of claim 8, further comprising the step of:

supporting said collet with said mandrel only in a radial direction against the object; and applying a force to the object when moving said fishing tool only relying on the collet to transmit the force applied.

13. A method of fishing for an object in a wellbore comprising:

lowering a fishing tool toward the object;

applying fluid pressure to said fishing tool;

displacing a mandrel away from support of at least one collet with said applied fluid pressure;

moving the tool with said fluid pressure applied until the object is engaged;

removing the applied fluid pressure; and returning said mandrel to a position where the collet is supported to secure the object;

creating said fluid pressure by flowing a fluid into said fishing tool;

biasing said mandrel to return it to a position where said collet is supported;

longitudinally moving a raised surface on said mandrel away from a head on a collet;

radially flexing the collet toward said mandrel;

facilitating attachment and release from the object by said radial flexing;

providing a constriction in a flowpath for the flowing fluid through said body; and using the backpressure created by said constriction to move said mandrel.

14. The method of claim 13, further comprising the steps of:

directing said backpressure into a variable volume chamber;

forming said chamber at least in part with said mandrel; and expanding the chamber against said opposing biasing force.

15. The method of claim 14, further comprising the step of:

directing said backpressure through said collet and into said chamber.

16. A fishing tool for retrieving an object from a wellbore comprising:

a body;

at least one gripping member mounted to said body;

a mandrel movably mounted to said body between a first position where it supports said gripping member and a second position where it does not support said gripping member, said mandrel responsive to fluid pressure for movement between its said first and second position to facilitate engagement of the object by said gripping member;

a biasing member acting on said mandrel to urge it toward its said first position; and said body is formed having a bore therethrough in fluid communication with said mandrel whereupon applied pressure in said bore overcomes said biasing member to urge said mandrel toward its said second position;

said mandrel forms a variable volume cavity with said body;

said body formed having at least one port allowing fluid communication from said bore into said cavity;

whereupon application of fluid pressure in said bore, said port communicates such pressure to said variable volume cavity to urge said mandrel toward its said second position;

said port extends through said gripping member which is mounted to said body;

said gripping member having a bore therethrough and smaller than said bore in said body to cause a backpressure in said bore in said body upon flow therethrough which is in turn communicated to said cavity.

* * * * *